US006966714B2

(12) United States Patent
Harris et al.

(10) Patent No.: US 6,966,714 B2
(45) Date of Patent: Nov. 22, 2005

(54) DUPLEX CHECK PRINTER HAVING A SEPARATELY DRIVEN DOCUMENT INVERTING LOOP

(75) Inventors: Richard Hunter Harris, Raleigh, NC (US); Robert Andrew Myers, Cary, NC (US); Jeff David Thomas, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/783,852

(22) Filed: Feb. 20, 2004

(65) Prior Publication Data

US 2005/0186007 A1 Aug. 25, 2005

(51) Int. Cl.[7] ..... B41J 17/00

(52) U.S. Cl. ..... 400/188; 271/184; 271/186; 399/401

(58) Field of Search ..... 400/188, 634, 400/642; 399/401; 271/184, 185, 186; 355/24

(56) References Cited

U.S. PATENT DOCUMENTS 5,513,840 A * 5/1996 Fujita et al. ..... 271/301
5,865,547 A 2/1999 Harris et al.
5,940,543 A * 8/1999 Isemura et al. ..... 382/284
5,974,283 A * 10/1999 Cho ..... 399/75
6,109,521 A 8/2000 Martinez et al.
6,257,783 B1 * 7/2001 Hanaoka et al. ..... 400/578
6,296,405 B1 10/2001 Brewington et al.
6,299,365 B1 10/2001 Harris et al.
6,325,585 B1 * 12/2001 Sasaki et al. ..... 412/11
6,332,068 B2 * 12/2001 Blackman et al. ..... 399/364
6,474,387 B1 * 11/2002 Shimao ..... 156/364
6,621,997 B2 * 9/2003 Chung ..... 399/122
6,862,428 B2 * 3/2005 Sasaki ..... 399/401

* cited by examiner

*Primary Examiner*—Daniel J. Colilla
*Assistant Examiner*—Dave A. Ghatt
(74) *Attorney, Agent, or Firm*—Jeanine S. Ray-Yarletts; Ronald V. Davidge

(57) ABSTRACT

A duplex check printer includes an upper document path, a print head at one side of the upper document path, and a lower document path having a loop to invert a check so that information can be printed on both sides of the check. The check is driven within the upper document path by feed rolls, which are reversed when the check is driven from the upper document path to the lower document path. The check is driven within the lower document path by belts, which are in turn driven by a separate motor.

19 Claims, 2 Drawing Sheets

DUPLEX CHECK PRINTER HAVING A SEPARATELY DRIVEN DOCUMENT INVERTING LOOP

BACKGROUND OF THE INVENTION

1. Field of the Invention

This invention relates to a point of sale printer for printing information on both sides of a check, and, more particularly, to such a printer having a loop around which the check is fed to invert it between the processes of printing on the two opposites sides.

2. Description of the Related Art

In continuing attempts to provide more efficient and convenient service to customers, many retailers have begun to use point of sale check printers to reduce the time required for a customer to fill out and sign a check. Such a printer automatically enters the date, the total cost of purchases, and the name of the retail establishment to which payment is being made, in the corresponding spaces of a check provided by the customer. The signature line is left blank, to be filled in by the customer after he is presented with the printed check.

Another form of printing performed on a check by the retailer comprises printing the franking information on the reverse side of the check. This information generally indicates that the check is for deposit only or that it is to be deposited to a particular account. While it is not necessary to perform this printing operation at the point of sale, many retail establishments have a policy of printing this information, with a rubber stamp if necessary, at the point of sale, reducing the likelihood of financial losses from checks that may otherwise be stolen without the franking information.

U.S. Pat. Nos. 5,865,547 and 6,109,521 describe duplex point-of-sale check printers including a first document path extending past a print element disposed on one side of the first document path and a second document path formed as a loop extending from an end of the first document path. A check is fed from the first path to the second path and around the loop within the second path, to be fed back into the first path, having been turned over by traveling along the loop. During this process, the check is fed in one direction around the loop, but in both directions along the first document path.

In the apparatus of U.S. Pat. No. 5,866,547, the check is driven within the first document-path by means of a first pair of feed rolls turning to move the check into the second document path. The check is then fed along the second paper path by means of rolls and belts turning constantly to move the check along in one direction around the loop. Before the check enters the first pair of feed rolls, these rolls are moved apart so that they do not drive the check, even through they continue to turn in directions that would drive the check back toward the second document path. In this way, a single rotational drive is used to drive both the first pair of feed rolls and the various elements of the second document path at constant speeds and directions. However, a problem with this method arises from the fact that if a corner or a part of an edge of the check has become folded back, movement of the check may be stopped when the folded part, having a greater effective thickness, is moved into the space between the first pair of feed rolls, resulting in a jammed condition. Another problem with this method arises from the fact that the check must be driven outward, along the first document path, by the drive mechanism of the second document path. In some applications, the first document is too long for this to work. Therefore, an apparatus is needed in which the directions of rotation of the first pair of feed rolls are controlled separately from the directions of the various drive elements in the second paper path.

In the apparatus of U.S. Pat. No. 6,109,521, the first directions of rotation of the first pair of feed rolls are reversed between the process of driving the check into the second document path and the process of removing the check from the second document path. The directions of the first pair of rolls are reversed by reversing a drive motor. The drive elements within the second paper path are driven from a gear attached to a roller within the first pair of feed rolls, through a gear train in which the number of idler gears is changed by one as the directions of the first pair of rollers are reversed, so that the directions in which the various elements within the second document path remain the same. What is needed is a system providing for the reversal of the first pair of feed rolls without requiring the use of a gear shifting transmission.

Other patents describe alternative methods for printing both sides of a check. For example, U.S. Pat. No. 6,299,365 shows a duplex check printer in which an end of the check is folded within a rotor to be fed back into a document path extending by the print head. U.S. Pat. No. 6,296,495 describes a duplex check printer in which the check is fed into diverging document paths, with a single print head being pivoted into place between the document paths to print on both sides of the check.

SUMMARY OF THE INVENTION

According to one aspect of the invention, a duplex check printer is provided, including a first document path in which at least one first document driving member, driven by a first motor in a first direction, engages a check to drive the check in a forward direction toward an internal end of the first document path. The first motor also drives the at least one first document driving member in a second direction to move the check in the first document path in a reverse direction, opposite the forward direction. A print head is disposed adjacent a first side of the first document path. The duplex check printer further includes a second document path, extending form the first document path, forming a loop to invert a check driven around the second document path in a preferred direction by a second motor driving at least one second document driving member. The first and second motors are separately controlled.

The check is understood to be driven in the direction of its length, i.e. its longer dimension, with the front and reverse sides of the check being reversed in position as the check is driven around the loop.

For example, the second motor is a permanent magnet direct current motor driving the second document driving member(s), which include a pair of document drive belts, through a reduction gear train.

The duplex check printer preferably additionally includes means for determining when a check being driven into the second document path from the first document path is moved past the first document driving member(s), together with control means causing the first motor to drive the first document driving member(s) in the second direction in response to a determination that the check being driven into the second document path from the first document path is moved past the first document driving member(s). This determination may be made by monitoring the output of a document sensor disposed between the first document drive member(s) to detect the presence of a check. Alternately, this determination may be made by determining that the check has been driven through a certain distance by the first document driving member(s). For example, the first motor may be stepper motor, which is driven by a pattern of pulses to move the check through the certain distance, and which in turn drives a roller forming a t least a portion of the first document driving member(s).

The duplex check printer may additionally include a document tray extending from the internal end of the first document path; and a gate moved between first and second positions. The gate is arranged so that a check driven from the first document path in the forward direction is driven along the document tray with the gate in the first position and into the second document path with the gate in the second portion.

In accordance with another aspect of the invention, a method is provided for printing on both sides of a check, wherein the method includes:

a) printing information on a first side of the check as the check is moved along a first document path by at least one first document driving member;

b) moving the check through the first document path with the at least one first document driving member moving in a forward direction and into a second document path;

c) determining that the check has moved past the at least one first document driving member;

d) reversing a direction of motion of the first document driving member to move in a reverse direction in response to determining that the check has moved past the at least one document driving member;

e) moving the check through a loop within the second document path by at least one second document driving member driven separately from the first document driving member to invert the check;

f) moving the check from the second document path back into the first document path and within the first document path with the first document driving member moving in the reverse direction; and g) printing information on a second side of the check, opposite the first side of the check, as the check is moved along the first document path by at lease the at least one first document driving member.

Either or both steps a) and e) may include moving a check between a document tray and the first document path, with a gate being provided to deflect a check being moved from the first document path into either the document tray or the second document path, according to the position of the gate.

DETAILED DESCRIPTION OF THE INVENTION

Figure 1:
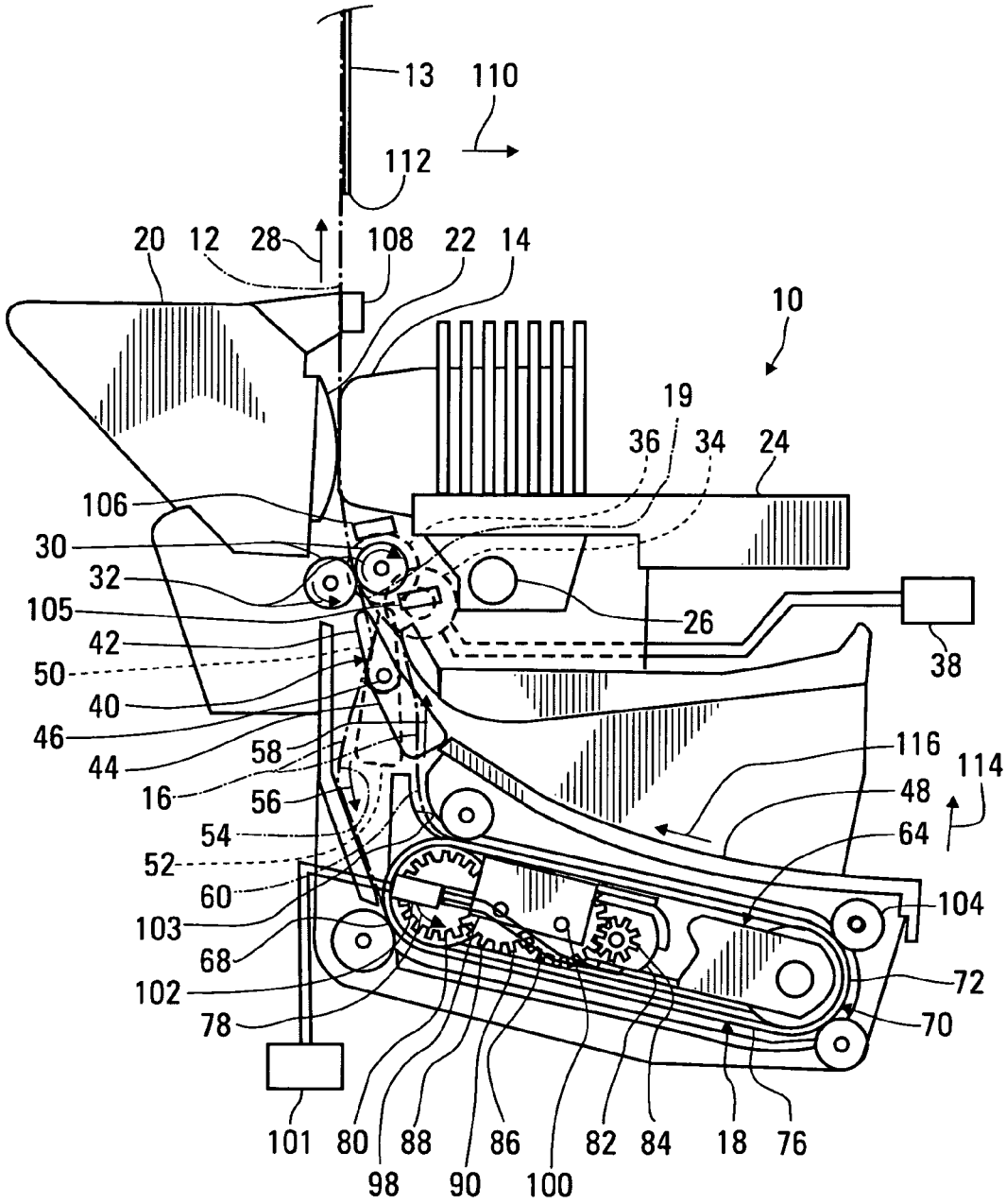
FIG. 1 is a left elevation of a duplex check printer built in accordance with the invention.

FIG. 1 is a left elevation of a duplex check printer 10 built in accordance with the invention, shown with a left side plate removed to reveal the internal structure. The duplex check printer 10 includes a first document path 12, along which a check 13 is moved past a print head 14 disposed adjacent one side of the first document path 12, and a second document path 16, along which the check 13 is moved in a loop around a check inverting cartridge 18. The second document path extends from an internal end 19 of the first document path 12. The check printer 10 additionally includes a platen 20 presenting a printing surface 22 at the first document path opposite the print head 14. The print head 14 is mounted on a carriage 24 that is moved along a shaft 26 in the directions perpendicular to the plane of the paper in FIG. 1 to move the print head 14 in the direction of the width (shorter dimension) of a check 13 within the first document path 12.

Relative movement between the check 13 and the print head 14 in the direction of the length (longer direction) of the check 13 outward, in the reverse direction of arrow 28 by rotation of the first pair of drive rolls 30 in the directions indicated by the arrows 32 thereon, and by moving the check 13 inward, in the forward direction opposite arrow 28, by rotation of the first pair of drive rolls 30 opposite the directions indicated by arrows 32 thereon. For example, a stepper motor 34 is used to drive one or both of the drive rolls 30 in both directions by means of a gear train 36. If only one of the drive rolls 30 is directly driven by the gear train 36, the other drive roll 30 is driven as an idler through contact with the driven roll 30 or through contact with a check 13 moving between the rolls 30. The stepper motor 34 is driven by pulses from control logic 38. An advantage of this method for rotationally driving the drive rolls 40 arises from the fact that the pattern of pulses used to drive the motor 38 consistently determines the rotational position of the stepper motor 34 to control the formation of characters during the use of the print head 14 as the check 13 is moved along the first document path 12. Alternately, a permanent magnet motor may be used to drive the rolls 30, with an emitter being used to provide a signal indicating the location of one of the rolls 30, so that the print head 14 can be driven to produce accurately formed characters.

It is understood that the drive rolls 30 are exemplary of document driving members moving the check 13 within the upper document path 12. Additional rolls may be used, spaced along the upper document path 12 from the rolls 30 and driven in rotation with the rolls 30, if it is necessary to drive the check 13 through a greater distance within the upper document path 12.

The duplex check printer 10 further includes a gate assembly 40, comprising an upper gate 42 and a lower gate 44, each of which is pivotally mounted on a shaft 46. With the upper gate 42 and the lower gate 44 in the positions in which they are shown, a check 13 can be moved in either direction between the first document path 12 and a document tray 48. Alternately, the upper gate 42 is pivoted into an alternate position, indicated by dashed lines 50, while the lower gate is pivoted into an alternate position, indicated by dashed lines 52, to direct a check 13 fed from the first document path 12 in the forward direction opposite arrow 28 into the lower portion 54 of second document path 16. The check 13 then moves through this lower portion 54 in the direction of arrow 56. Then, the upper gate 42 is pivoted into the position in which it is shown, with the lower gate 44 remaining in the position indicated by dashed lines 52, to allow the check 13 to move in the direction of arrow 58 along the upper portion 60 of the second path 16.

Preferably, the movement of the print carriage 24 to a predetermined end of the shaft 26, moving the print head, 14 beyond the range of movement used for printing on a check 13, is used to effect movement of the gate assembly 40 between the configuration used to allow movement of the check 13 between the upper paper path 12 and the document tray 48 and the configuration used to invert the check 13 with movement around the second paper path 16. A mechanism for moving the gate assembly 40 in this manner is described in U.S. Pat. No. 5,865,547, the disclosure of which is incorporated herein by reference. Alternately, the movement of gate assembly 40 may be provided by other means well known to those skilled in the art of mechanism design, such as the use of solenoids.

Figure 2:
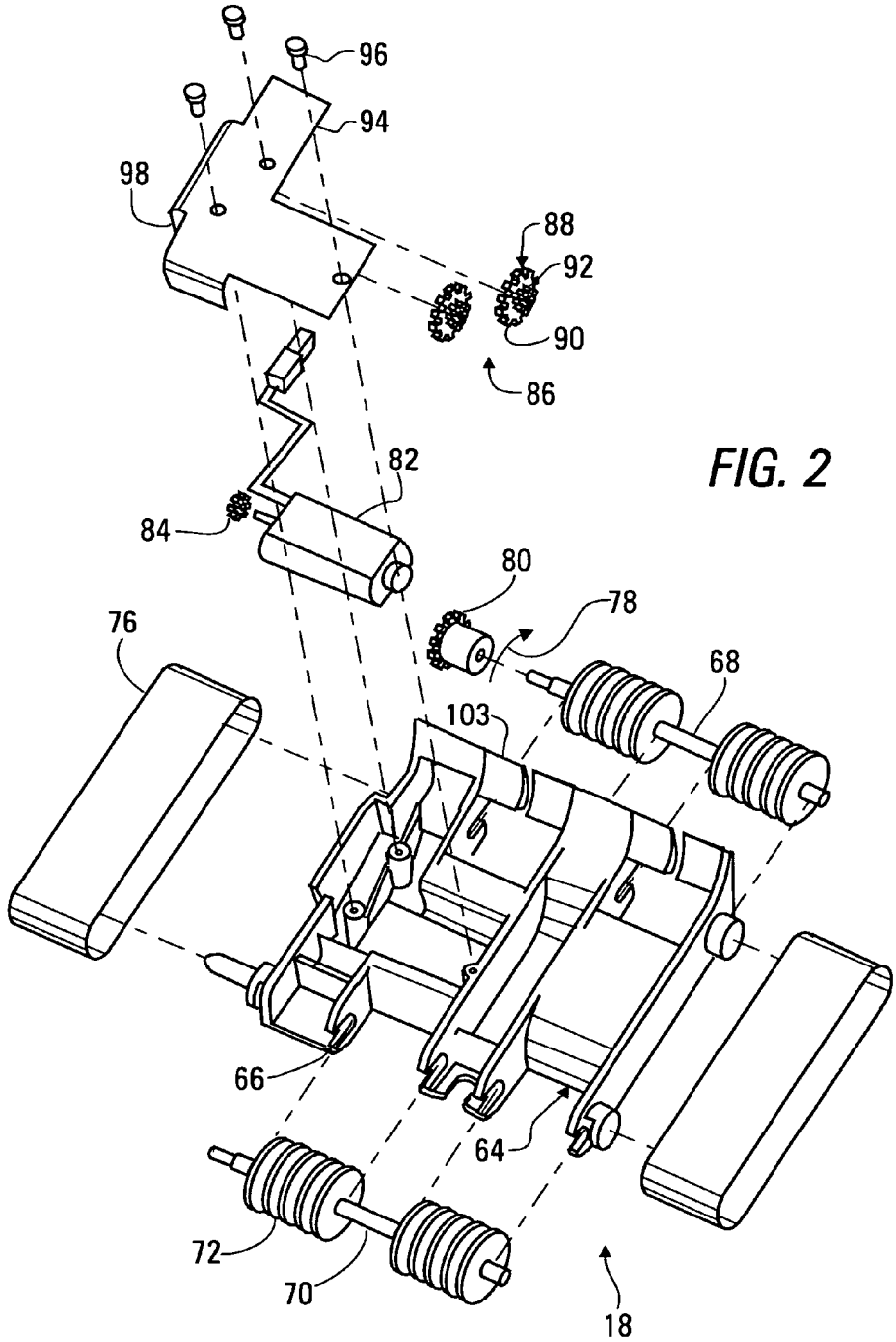
FIG. 2 is an exploded view of a check inverting cartridge within the duplex check printer of FIG. 1.

Features of the check-inverting cartridge 18 will now be explained with continued reference being made to FIG. 1, and with additional reference being made to FIG. 2, which is an exploded perspective view of the cartridge 18.

The check-inverting cartridge 18 includes a frame 64 providing bearing surfaces 66 in which a first belt shaft 68 and a second belt 70 turn. (In FIG. 1, a portion of the frame 64 is shown as cut away to reveal the structure of the cartridge 18.) Each of these shafts 68, 70 includes a pair of rollers 72 having a peripheral surface formed as a number of disks. The cartridge 18 additionally includes a pair of document drive belts 76 extending over the rollers 72. The first shaft 68 is rotationally driven in the direction of arrow 78 by means of a shaft drive gear 80 fastened thereto, which is in turn driven by a motor 82, having a motor gear 84 attached to its shaft, through a speed reduction gear train 86. The motor 82 is preferably a direct-current, permanent magnet type. The speed reduction gear train 86 includes a pair of idler drive gears 88. Each of the idler drive gears 88 includes a large gear surface 90 and a small gear surface 92. The motor 82 is held in place within the frame 64 by means of a bracket 94 fastened to the frame 64 with screws 96. The bracket 94 also includes a tab 98 holding pins 100 on which the idler drive gears 88 rotate. The motor 82 is connected to a switched voltage source 101 through a connector 102 attached to the frame 64. The frame 64 additionally includes a number of upwardly extending tabs 103 stripping a check 13 moving along the upper portion 60 of the second document path 16 from the document drive belts 76.

Continuing to refer to FIG. 1, the duplex check printer 10 also includes a number of idler rollers 104 held against the drive belts 76 to roll with the movement of the belts 76 and to hold the check in contact with the belts to provide for its accurate and reliable movement with the movement of the belts 76.

The duplex check printer 10 further includes one or more document sensors for indicating whether a check 13 is present at a particular point in the first document path 12, which may be optical devices, pneumatic devices, or mechanical switches, configured as well known to those skilled in the art of designing devices through which individual documents are moved. For example, the duplex check printer 10 includes a lower document sensor 105, sensing the presence of a check 13 below the first pair of drive rolls 30 and an upper document sensor 106, sensing the presence of a document above the drive rolls 30.

The duplex check printer 10 may also include a magnetic ink character reader (MICR) 108, magnetizing the characters previously printed on the check 13 using a magnetic ink and reading the magnetic pattern of the characters as the check 13 is moved along the first document path 12, either in the direction of arrow 28 or opposite this direction. In this way, the customer's bank account may be located from the routing number and account number printed on the check 13 using magnetic ink, with this information being used, if desired, to verify that sufficient funds are available to cash the check.

The duplex check printer 10 is preferably used to print a first side of a check 13 with the check 13 being moved along the first document path 12 and, if necessary, additionally along the document tray 48. Then the check 13 is inverted by being fed around the loop of the second document path 16. Next the other side of the check 13, opposite the first side thereof, is printed with movement along the first document path 12 and, if necessary, additionally along the document tray 48. The side of the check 13 that is printed first may be the front side of the check 13 or the reverse side of the check 13.

In either case, one or more lines of information on the front side of the check 13 are printed with the print carriage 24 being held in a fixed position on the shaft 26. For example, two lines of information may be printed on the front of the check 13 during movement of the check 13 along the first document path 12 in a first direction and in a direction opposite the first direction, and with the print carriage 24 being moved along the print shaft between the movement of the check 13 in the direction opposite the first direction through a distance moving the print head 14 from the position in which the first line of information is printed and the position in which the second line of information is printed.

On the other hand, one or more lines of information on the reverse side of the check 13 are printed with the check 13 being held in fixed position in the upper document path as the print carriage 24 is moved along the shaft 26. For example, multiple lines of franking information may be printed as the check 13 is moved in a stepping motion along the first document path 12 with the print carriage 24 being moved to move the print head 14 across the width of the check 13 as the check 13 is held in place for each line to be printed.

The MICR reading device 108 is optionally used to magnetize magnetic characters extending in a single line on the front side of the check 13 and to read these characters by sensing the pattern of the magnetic field in a manner well known to those skilled in the art of designing check 13 processing equipment. This MICR reading process, if used, occurs during movement of the check 13 along the first document path 22.

Alternately, the MICR reading device 108 may be replaced by an optical reading device, which is used to read the line of magnetic characters by scanning these characters as the check 13 is moved along the first document path 12. Such an optical reading device can also be further extended to read other information printed on the check 13, with both sides of the check 13 being read, if necessary, in scanning operations occurring before and after the check 13 is driven through the second document path 16.

The process of printing a check 13 begins with the document gates 42, 44 in the position shown. According to a first method for practicing the invention, a check 13 is introduced into the first document path 12, with the front side of the check 13 facing forward, in the direction of arrow 110. The check 13 is then manually pushed downward, in the forward direction opposite the direction of arrow 28 until the leading edge 112 of the check 13 is sensed by the upper document sensor 106. The document drive motor 34 is then used to move the check 13 downward along the first document path 12, with the leading edge of the check 13 moving along the document tray 48, until the presence of the check 13 is no longer sensed by the upper document sensor 106. During this first movement of the check, the MICR reader 108 can be used to read data imprinted on the check, and the length of the check may be determined by the distance moved between the initial sensing of the check by the upper document detector 106 and the time at which the check is no longer sensed by this detector 106. Optionally, a first line of information may be printed during this first movement of the check 13 along the first document path 12. On the other hand, if neither the results of reading MICR data printed on the check nor the determination of the length of the check are deemed to be necessary before a first line of information is printed on the check 13, a first line of information may be printed on the check 13 during this first downward movement of the check 13 along the first document path 12.

The process of printing information on the front side of the check 13 then continues, with the gate mechanism 40 in the position shown, so that the check 13 moves along the first document path 12 and the document tray 48. The check 13 remains between the first drive rolls 30, with downward movement of the check 13, in the forward direction opposite the direction of arrow 28, being stopped when the presence of the check 13 is no longer sensed by the upper document sensor 106, and with upward movement of the check 13, in the reverse direction of arrow 28, being stopped when the presence of the check 13 is no longer sensed by the lower document sensor 105.

In one version of this method, additional information is printed on the front side of the check 13 in a last pass moving downward, in the forward direction opposite the direction of arrow 28, with the gate mechanism 40 being moved into the positions indicated by dashed lines 50, 52, so that the check 13 is directed to follow the lower portion 54 of the second document path.

In another version of this method, the print carriage 24 is moved to one side along the shaft 26 and held in this location, so that printing cannot occur during this last downward movement of the check 13 before it is inverted. with this movement of the print carriage causing the movement of the gate mechanism 40 into the positions indicated by dashed lines 50, 52.

Alternately, a similar process for first printing the front side of the check 13 is begun by placing the check on the document tray 48 with the front side of the check facing upward, in the direction of arrow 114. The check is then moved manually in the direction of arrow 116 until the lower document sensor 105 indicates the presence of the edge of the check. Then the stepper motor 34 is turned on to move the check 13 within the first document path 12 in the reverse direction of arrow 28, with multiple movements of the check 13 then being used to print information on the front side of the check, and to read the MICR data, as described above.

Before the check 13 is moved into the second document path 16, the motor 82 is turned on to drive the belts 76 so that the check 13 is moved along the second document path 16. The check 13 is inverted, with the front side of the check being moved to face upward, as the check is moved along this second document path 16. The check 13 is stripped from the belts 76 by the upwardly extending tabs 103 to follow the upper portion 60 of the second document path 16. With the lower gate 52 remaining in the positions indicated by dashed lines 52, and with the upper gate 42 being pivoted back into the position in which it is shown, the check is moved along the upper portion 60 of the second document path 16 to be returned to the first document path 12 at its inner end 19.

The process of printing information on the reverse side of the check 13 then begins when the check 13 is moved within the first document path 12 so that the area in which franking information is to be printed is adjacent the print head 14. Then, the check is held in position, while the print carriage 24 is moved along the shaft 26 to print data. If necessary, the check 13 may be moved through a small distance along the upper paper path 12 one or more times to print additional lines of franking information. Then, the check is driven upward, in the reverse direction of arrow 28 until the check is driven from the rolls 30, 32, so that the check can be manually removed from the upper document path 12.

Alternately, the check 13 may be driven upward until the lower document sensors 105 indicate that the lower end of the check has been brought to the rollers 30, 32. Then, the lower gate 44 is pivoted to the position in which it is shown from the position indicated by dashed lines 54, and the check 13 is driven in the forward direction, opposite the direction of arrow 28, until it has been driven from the rolls 30, 32 along the document tray 48, from which it is then manually removed.

While the preceding discussion has described the front side of the check 13 as being printed first, it is understood that an alternative method of the invention provides for printing the reverse side of the check first, with adjustments being made in the movements of the check 13 and of the print carriage 24 to provide for printing franking information across the check during the first printing operation and to provide for printing information along the length of the check 13 during the second printing operation. The check 13 is originally inserted in the upper document path 12 with the reverse side of the check facing the direction of arrow 110, or, alternately, on the surface of the document tray 48 with the reverse surface of the check facing in the direction of arrow 114. If the reverse side of the check is to be printed first, the MICR reader 108 may be moved to the other side of the first document path 12, so that the MICR characters may be read during the first printing operation.

It is further understood that a device may be built in accordance with the invention without a document tray 48, and with the lower gate 44 being replaced by a stationary member in the position indicated by dashed lines 52. The check 13 is then moved into the second paper path 16 and removed therefrom, preferably with the assistance of the motor 82 being alternately driven in both directions, to effect printing operations requiring movements past the inner end 19 of the upper document path 12. The check 13 is inserted into, and removed from, the upper document path 12.

While the above discussion has described the use of document position sensors 105, 106 at each side of the document drive rolls 30, it is understood that only one such sensor is needed, preferably positioned to detect the end of a check when it is manually inserted into the printer 10. During print operations, and when the check 13 is driven into the second document path 16. the distance through which the check 13 is moved is determined from the pulse pattern used to drive the stepper motor 34.

While the preceding discussing has described a number of alternative methods for operation of the printer 10 in accordance with the invention, it is understood that only one such method is required for operation of the printer 10. While a preferred embodiment of the device and of various methods for its operation have been described with some degree of particularity, it is understood that this description has been given only by way of example, and that many variations in the combination and arrangement of parts and in the process of operation may be made without departing from the spirit and scope of the invention, as defined in the appended claims.

What is claimed is:

1. A duplex check printer, comprising:

a first document path including an internal end;

at least one first document driving member engaging a check in said first document path to drive said check in a forward direction toward said internal end and in a reverse direction, opposite said forward direction;

a first motor moving said at least one first document driving member in a first direction to move said check in said forward direction along said first document path and in a second direction to move said check in said reverse direction along said first document path;

a print head disposed adjacent a first side of said first document path;

a second document path, extending from said internal end of said first document path, the second document path being a complete loop to invert a check driven around said second document path in a preferred direction;

at least one second document driving member engaging said check in said second document path to drive said document path to drive said check in said preferred direction; and a second motor driving said at least one second document driving member to move said check around said loop in said second document path in said preferred direction, wherein said first motor and said second motor are separately controlled.

2. The duplex check printer of claim 1, additionally comprising:

a document tray extending from said internal end of said first document path; and a gate moved between first and second positions, wherein said check driven from said first document path in said forward direction is driven along said document tray with said gate in said first position and into said second document path with said gate in said second portion.

3. A duplex check printer, comprising:

a first document path including an internal end;

at least one first document driving member engaging a check in said first document path to drive said check in a forward direction toward said internal end and in a reverse direction, opposite said forward direction;

a first motor moving said at least one first document driving member in a first direction to move said check in said forward direction along said first document path and in a second direction to move said check in said reverse direction along said first document path;

a print head disposed adjacent a first side of said first document path;

a second document path, extending from said internal end of said first document path, forming a loop to invert a check driven around said second document path in a preferred direction;

at least one second document driving member engaging said check in said second document path to drive said document path to drive said check in said preferred direction;

a second motor driving said at least one second document driving member to move said check around said loop in said second document path in said preferred direction, wherein said first motor and said second motor are separately controlled;

document position determining means for determining when a check driven into said second document path from said first document path is moved past said at least one first document driving member; and control means causing said first motor to drive said at least one first driving member to drive said at least one first driving member in said second direction in response to a determination by said document position determining means that said check driven into said second document path from said first document path is moved past said at east one document driving member.

4. The duplex check printer of claim 3, wherein said document position determining means includes a document sensor disposed between said at least one first document driving member and said internal end of said first document path.

5. The duplex check printer of claim 3, wherein said document position determining means includes a means for determining how far a check has been driven in said forward direction by said at least one first document driving member.

6. The duplex check printer of claim 5, wherein said at least one first document driving member includes a drive roller held in contact with a check moving along said first document path, said first motor includes a stepper motor, said document position determining means includes a circuit determining that a check has been driven through a predetermined distance in said forward direction by rotation of said stepper motor.

7. A duplex check printer, comprising:

a first document path including an internal end;

at least one first document driving member engaging a check in said first document path to drive said check in a forward direction toward said internal end and in a reverse direction, opposite said forward direction;

a first motor moving said at least one first document driving member in a first direction to move said check in said forward direction along said first document path and in a second direction to move said check in said reverse direction along said first document path;

a print head disposed adjacent a first side of said first document path;

a second document path, extending from said internal end of said first document path, forming a loop to invert a check driven around said second document path in a preferred direction;

at least one second document driving member engaging said check in said second document path to drive said document path to drive said check in said preferred direction;

a second motor driving said at least one second document driving member to move said check around said loop in said second document path in said preferred direction, wherein said first motor and said second motor are separately controlled; and a frame supporting said at least one second document member, wherein said at east one second document driving member includes at least one document drive belt extending between a drive roller assembly, rotatably mounted on said frame and driven in rotation by said second motor, and an idler roller assembly rotatably mounted on said frame, and wherein said second document path extends around said at least one document drive belt.

8. The duplex check printer of claim 7, wherein said second motor comprises a permanent magnet direct current motor.

9. The duplex check printer of claim 7, wherein said second motor is attached to said frame to be disposed within said at least one document drive belt, said second motor drives said drive roller assembly through a gear train additionally attached to said frame within said at least one document drive belt.

10. The duplex check printer of claim 7, additionally comprising a plurality of rollers disposed outwardly adjacent said at least one document drive belt to hold said check moving along said document drive belt in contact with said document drive belt.

11. A method for printing on both sides of a check, wherein said method includes:

a) printing information on a first side of said check as said check is moved along a first document path by at least one first document driving member;

b) moving said check through said first document path with said at least one first document driving member moving in a forward direction and into a second document path;

c) determining that said check has moved past said at least one first document driving member;

d) reversing a direction of motion of said first document driving member to move in a reverse direction in response to determining that said check has moved past said at least one document driving member;

e) moving said check through a loop within said second document path by at least one second document driving member driven separately from said first document driving member to invert said check;

f) moving said check from said second document path back into said first document path and within said first document path with said first document driving member moving in said reverse direction; and e) printing information on a second side of said check, opposite said first side of said check, as said check is moved along said first document path by at lease said at least one first document driving member.

12. The method of claim 11, wherein said at least one second document driving member comprises at least one document driving belt moving within said loop, driven by a motor separate from said at least one first document driving member.

13. The method of claim 11, wherein a determination that said check has moved past said at least one first document driving member is made by monitoring an output of a document sensor at said first document path between said at least one first document driving means and said second document path.

14. The method of claim 11, wherein a determination that said check has moved past said at least one first document driving member is made by determining a distance that said check has been driven by said at least one first document driving member driven in said forward direction.

15. The method of claim 14, wherein said at least one document driving member includes a roller driven by a stepper motor separate from said at least one second driving member.

16. The method of claim 11, wherein step a) includes moving a portion of said check between a document tray, separate from said second document path, and said first document path by said at least one first document driving member.

17. The method of claim 16, wherein step b) includes moving a gate to deflect said check into said second document path.

18. The method of claim 17, wherein step e) includes:

moving said gate to deflect said check onto said document tray; and moving a portion of said check onto said document tray from said first document path.

19. The method of claim 11, wherein step e) includes:

moving a gate to deflect said check onto a document tray separate from said second document path, and moving a portion of said check onto said document tray from said first document path.

* * * * *